US005207125A

United States Patent [19]

Pierce, Jr. et al.

[11] Patent Number: 5,207,125

[45] Date of Patent: May 4, 1993

[54] OPENER FOR SCREWED CAP CONTAINERS

[76] Inventors: Webster Pierce, Jr., 215 W. 58th St.; Mack Cheramie, 2415 E. Main, both of Cut Off, La. 70345

[21] Appl. No.: 754,628

[22] Filed: Sep. 4, 1991

[51] Int. Cl.[5] ..... B67B 7/18

[52] U.S. Cl. ..... 81/3.43; 81/3.2; 81/3.32; 81/3.33; 81/3.39

[58] Field of Search ..... 81/3.07, 3.2, 3.25, 81/3.31, 3.32, 3.33, 3.29, 3.39, 3.4, 3.43, 64, 65.2

[56] References Cited

U.S. PATENT DOCUMENTS

| | | | |
|---|---|---|---|
| 710,606 | 10/1902 | Pagett | 81/3.43 |
| 2,718,800 | 9/1955 | Olson | 81/3.43 |
| 2,937,548 | 5/1960 | McKim | 81/3.43 |
| 3,853,026 | 12/1974 | Rhodes | 81/64 |
| 3,950,801 | 4/1976 | Morrison | 81/3.2 |
| 4,114,481 | 9/1978 | Kowalczyk | 81/64 |
| 4,660,445 | 4/1987 | Windom | 81/3.43 |

*Primary Examiner*—Roscoe V. Parker
*Attorney, Agent, or Firm*—Pravel, Hewitt, Kimball & Krieger

[57] ABSTRACT

A new, novel device for holding a container while applying torque specifically to the closure in the direction of opening. This device is readily adaptable for use with an electric motor or ratchet to provide hands free operation The device may be made small enough to serve as a counter-top appliance for home use. In addition, the device is self sizing to serve a wide array of container closures.

13 Claims, 11 Drawing Sheets

OPENER FOR SCREWED CAP CONTAINERS

BACKGROUND OF THE INVENTION

1. Field Of The Invention

The apparatus of the present invention relates to container openers. More particularly, the present invention relates to a self sizing strap wrench apparatus to be utilized for securing a circular object, such as a container jar, in a fixed position while screwing or unscrewing a lid or top threadably engaged thereupon.

2. General Background

In the present state of the art, a problem is often encountered in the opening of containers with screw-type lids, such as jars or the like; particularly, by people who do not have the strength to break the seal, such as the elderly, women and children. It is found there is a need for a simple and reliable means to conduct such a chore for any individual so as to eliminate this problem.

There are certain devices now on the market such as the vee notch and cam-lock under cabinet, which attempt to solve the problem, but suffer from certain shortcomings; for example, such as being hazardous. These types are hazardous because, they require the user to hold the container in position while turning the container. If the container is glass the camable principle of these devices creates point loading often resulting in breakage, leading to sever lacerations to the user or contaminating the contents with broken glass.

There have been certain patents granted in the art which address these concern, the most pertinent that were found being as follows:

U.S. Pat. Nos. 710,606; 2,718,800; and 2,937,548 seems to indicate that container opening devices of the strap wrench type have proven to be the most successful method for conforming to different size containers and lids. Various methods are employed to secure such devices once a grip has been affected. In the patent to Pagett, the cam-lock principle is used wherein a fixed and a movable abutment is used in conjunction with a camable leaver attached to a fixed base plate to affect the gripping of a jar. A friction buckle arrangement is implemented along with a second handle for removing the lid.

The patents to Olson and McKim improved on the Pagett design by eliminating the fixed base and lower camable lever. These two principles make the assumption that the user could easily apply adequate force by turning the container, while the lid is being securely held in a fixed position. Both Olson and McKim as well as Pagett require the user to bring the container to the apparatus. Olson and McKim further requires that the container be held in one hand while adjusting the strap loop around the container lid. This is a tricky maneuver even for the most agile person when the container is wet, large or of unusual shape.

A patent to Morrison, U.S. Pat. No. 3,950,801 anticipated the foregoing problem, however, he failed to incorporate the teachings of Pagett, Olson, or McKim. The Morrison apparatus utilizes a friction pad both top and bottom for griping the container and the lid. Removal of the container lid depends entirely on the friction pad's ability to grip circular objects. The size limitation of any given apparatus and its lack of ability to provide a positive grip on wet, irregular shaped or smooth containers and their lids prevent the device from performing the feats of the present invention.

SUMMARY OF THE PRESENT INVENTION

The apparatus of the present invention solves the problems in the art in a simple and straight forward manner. What is provided is a container holder arrangement in combination with a closure opener that enables a person without normal hand and arm strength, such as a handicapped person or others in situations where more than average torque is required, to open closures of containers.

The apparatus of the present invention comprises a small solid disk having a shaft portion pivotally recessed inside a larger diameter disk in a manner that allows the smaller disk shaft portion to rotate concentrically inside the larger disk. A flexible binding strap is mounted with one end attached to the outer surface of the larger diameter disk and is passed through a slot in the lip of the large disk where the opposite end is attached to a binding post located eccentrically on the inner disk forming a loop, in such a manner that when one disk is moved concentric to the other the flexible binding strap spirally contracts to infinity, whereas further turns opens the loop to its starting position.

Contraction of the flexible binding strap causes a tightening around whatever is placed inside the binding strap, such a jar lid or the like. When the binding strap tightens around such a threaded lid, the flexible nature of the binding strap is enhanced by a friction strip adhered to the strap allowing it to grip the lid. As the smaller disk shaft portion continues to circle inside the larger disk, torque is applied to the lid by the circumferential friction generated by the binding strap's friction strip, for smaller lids or in combination with the friction strip, located on the interior lip of the larger disk. This griping of the jar's lid effectively locks the larger disk to the smaller disk, and the two disks as one to accomplish the task. Therefore to effect removal of a lid one must simply turn the torque head manually by means of a torque handle or an electrically operated torque wrench while retaining the jar.

If a person is unable to hold the container in order to prevent rotation by the container, a base holder design using the same principle may also be supplied to secure the container, which may be attached to a sturdy base or a counter top.

It can be seen that by adapting a small electric motor to turn the torque head of the opener by gear drive, while a stand supports the entire device, a convenient container opener for counter top use can be developed. The container holder design may be utilized in combination with the electrically driven torque head opener to provide a complete hands-free operation.

It is a principal object of the present invention to incorporate the positive locking strap methods, as taught by the previously discussed prior art, into the present invention whereby effortless removal of container lids is achieved without point loading the container.

It is a further principal object of the present invention to provide a full range adjustment from larger containers to smaller ones by its own innovative self adjusting means or by manual over ride.

It is still a further object of the present invention to provide a means for self sizing a cinch belt to fit and firmly hold a container or a closure. In at least one embodiment the need for the user to hold the container while using the opener is eliminated.

It is still a further object of the present invention to allow a person of normal abilities to use the invention by simply holding the container while turning manually or driving electrically, the invention's torque head.

It is a further principal object of the present invention to provide a new and improved self adjustable opener for screw on lid type container closures without point loading or crushing such lids.

It is a further object of the present invention is to allow persons without full use of their arms or hands to open screw on lid type containers.

It is a further object of the present invention to provide a small convenient apparatus for the home that will quickly and easily open screw on lid type containers.

It is a further object of the present invention to provide a hands-free appliance operated by an electrical motor that is capable of removing container screw on lids.

It is a further object of the present invention to provide a safe holder, for glass containers or the like so that torque can be applied circumferentially to screw on lids.

It is a further object of the present invention to provide a means of removing screw on type container closures by applying torque to the torque head with a manually operated lever or by an electrical torque wrench.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 9:
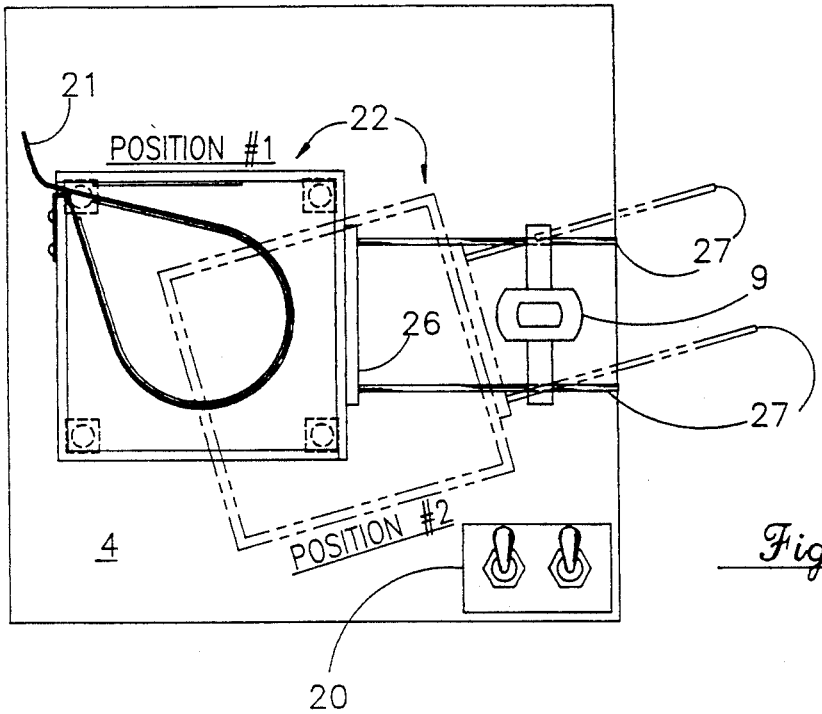
FIG. 9 is a plan view of the lower containment portion of the electrically operated self contained closure opener embodiment of the present invention showing maximum travel positioning with guide rod option.

The preferred embodiment of the present invention as shown in FIGS. 1 through 5 depicting a base plate 4 on which is mounted a gear housing 9 containing the rack drive gears and cross drive motors for raising, lowering and pivoting the drive motor and torque head assembly 16 and a control switch box 20. The base plate 4 serves as a skid plate for the lower containment portion 22. A pair of slotted ears 8 extending from the sides of the gear housing 9 serve as guides for the guide rods 27 connected to the rear of the lower containment portion 22. A rack shaft 12 extending vertically from the gear housing 9 is pivotally connected to a horizontal bar 14 connected in turn to the electrical drive motor housing 16. The rack 10 can be driven vertically and rotated to acute angles by cross drive motors located within the gear housing 9. The horizontal bar 14 may be pivotally lifted manually at its pivot joint 13 with the rack shaft 12. A container 24 whose closure is to be opened is placed in the containment portion 22 within the loop of the containment friction strap 21. The rack shaft 12 is driven down until the torque head assembly 70 coupled to the drive motor 17 located inside the drive head housing 16 is in contact with the container 24 closure. The containment friction strap 21 may be clinched tightly by hand or allowed to be pulled tight by friction when it is in contact with the container 24. The drive head motor 17 may be rotated electrically in either direction. Friction applied to the larger outer disk 18 of the torque head assembly 70 by the biased friction disk assembly 49 prevents free rotation of the torque head assembly 70. Thereby allowing only the head's smaller inner disk 38 to rotate the drive motor 17. A self sizing friction strap loop 34 located within the drive head is reduced in size until cinched tightly around the container closure 25 locking both inner disk 38 and outer disk 18 together. Continued rotation of the drive motor 17 causes the locked head assembly to rotate the container 24. The rotating container 24 creates friction on the containment friction strap loop 19, 21, drawing the containment portion 22 towards the container 24 until the container and its friction strap loop 19, 21, becomes tightly wedged into the front corner consisting of walls 29, 33 of the containment portion 22. The self sizing cinching process of the friction strap loop 19, 21, is assisted by a lubricated strap 23 located on the inner side of the containment portion wall 29. Rotation of the containment portion 22 is restricted, to the path shown in FIG. 9, by the guide rods 27. The container 24 being therefore prevented from rotating, further torque to the closure 25 results in its closure removal from the container. Over torquing the closure 25 is prevented by torque limiting features in the drive motor 17. Ease of movement of the containment portion 22 is facilitated by the use of a plurality of roller bearing assemblies 28 mounted on the base of the containment portion 22 and rolling on the base plate 4. The friction loop 21 is secured at one end to the exterior side of the containment wall 33 by rivets 32 forms a loop inside of the containment portion and exits by way of a slot 30 in the containment wall 33.

The torque head assembly 70 is comprised of a small disk 38 having a shaft portion 39 rotatable and concentrically fitted inside a larger disk 18 having a raised cylindrical wall. The larger disk 18 is rotatable about the shaft portion 39 of the smaller disk 38. A strap 34 fixed to the exterior of the raised wall of the larger disk 18 is positioned through a slot 40 in the raised wall. The opposite end of the strap 34 forms a loop 37 and is fixed to itself. The looped end 37 is positioned around a pin 42 attached perpendicular to the face opposite the shaft portion of the small disk 38. The strap 34 further comprises a friction strip 35 adhered to one face. A friction strip 36 is also adhered to approximately one half of the inside of the raised wall of the larger disk 18.

Figure 1:
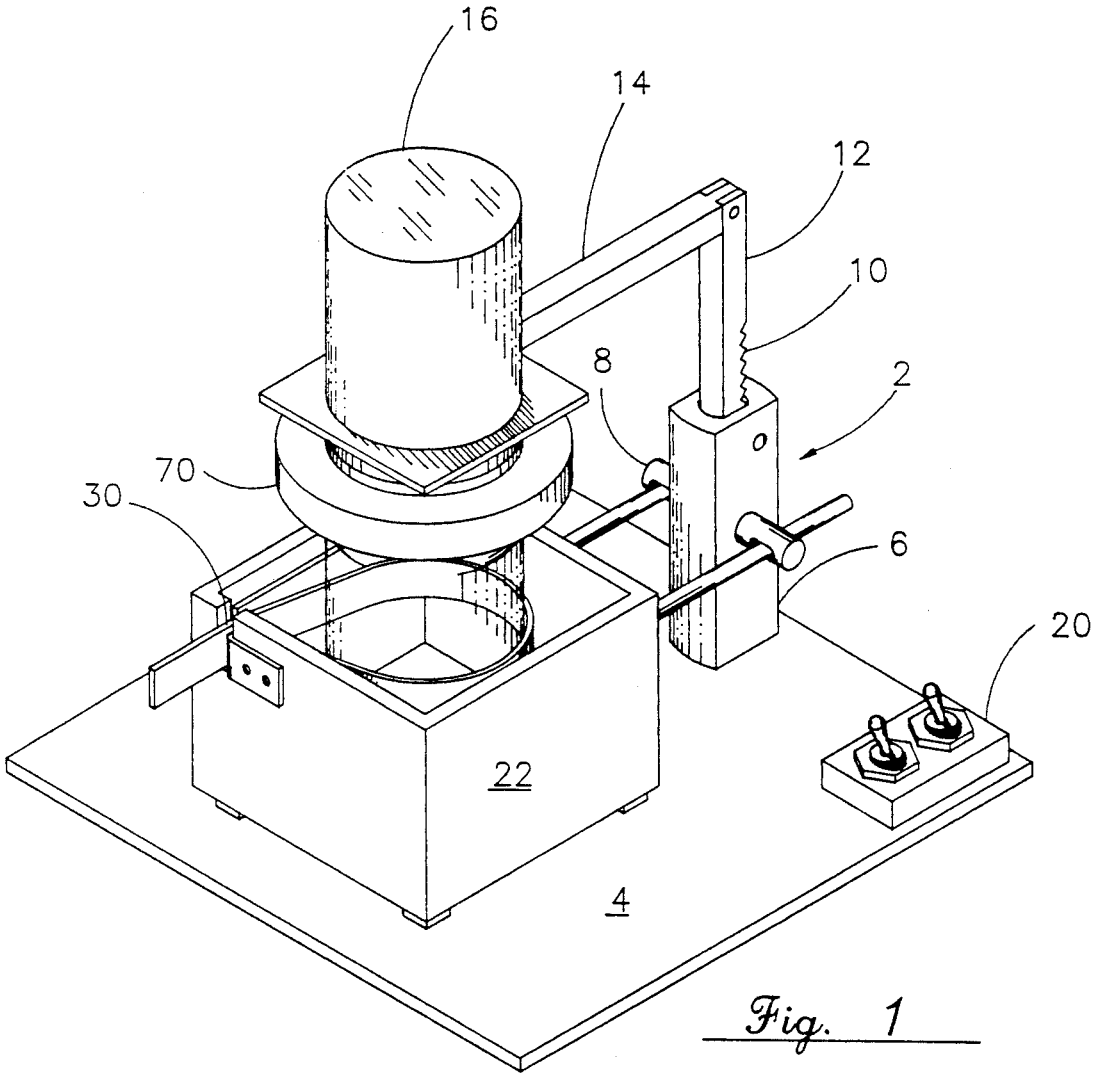
FIG. 1 is an isometric view of the electrically operated self contained closure opener embodiment of the present invention with the opening mechanism shown in association with a container.
Figure 2:
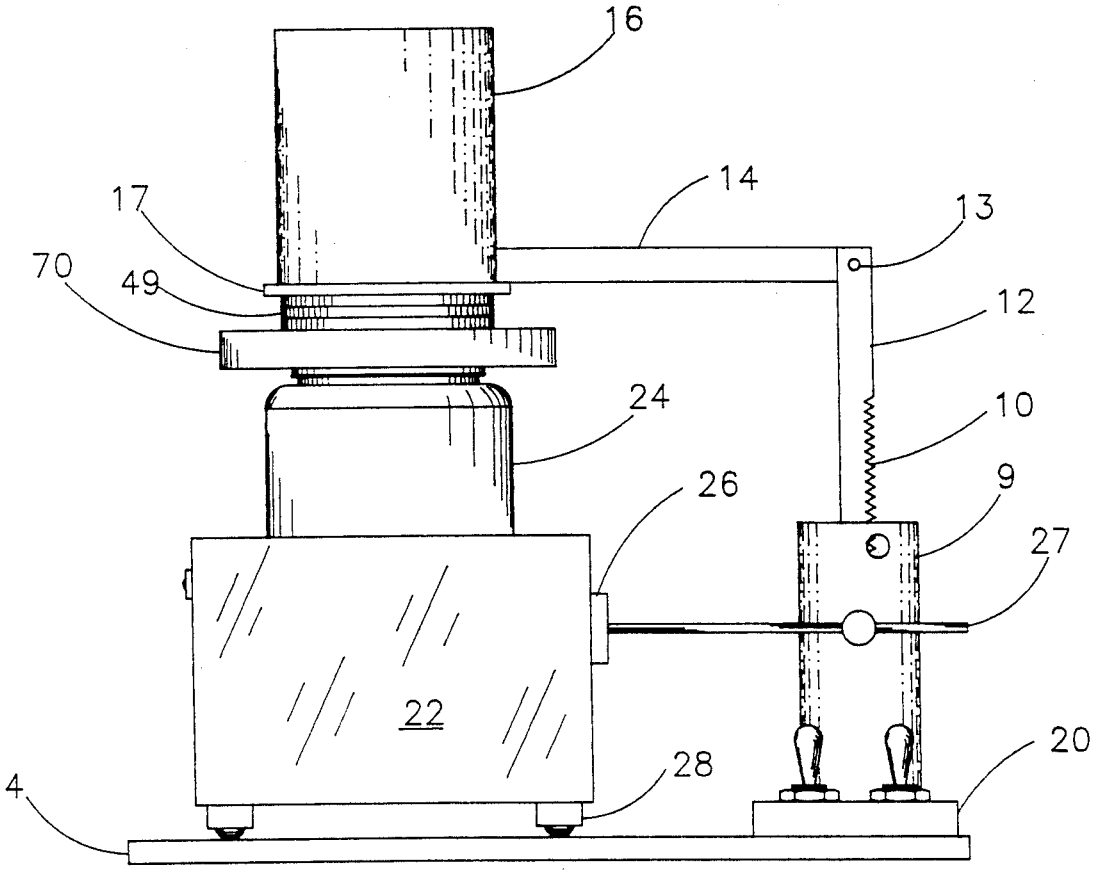
FIG. 2 is a side elevational view of the electrically operated self contained closure opener embodiment of the present invention with the opening mechanism shown in contact with the container.
Figure 3:
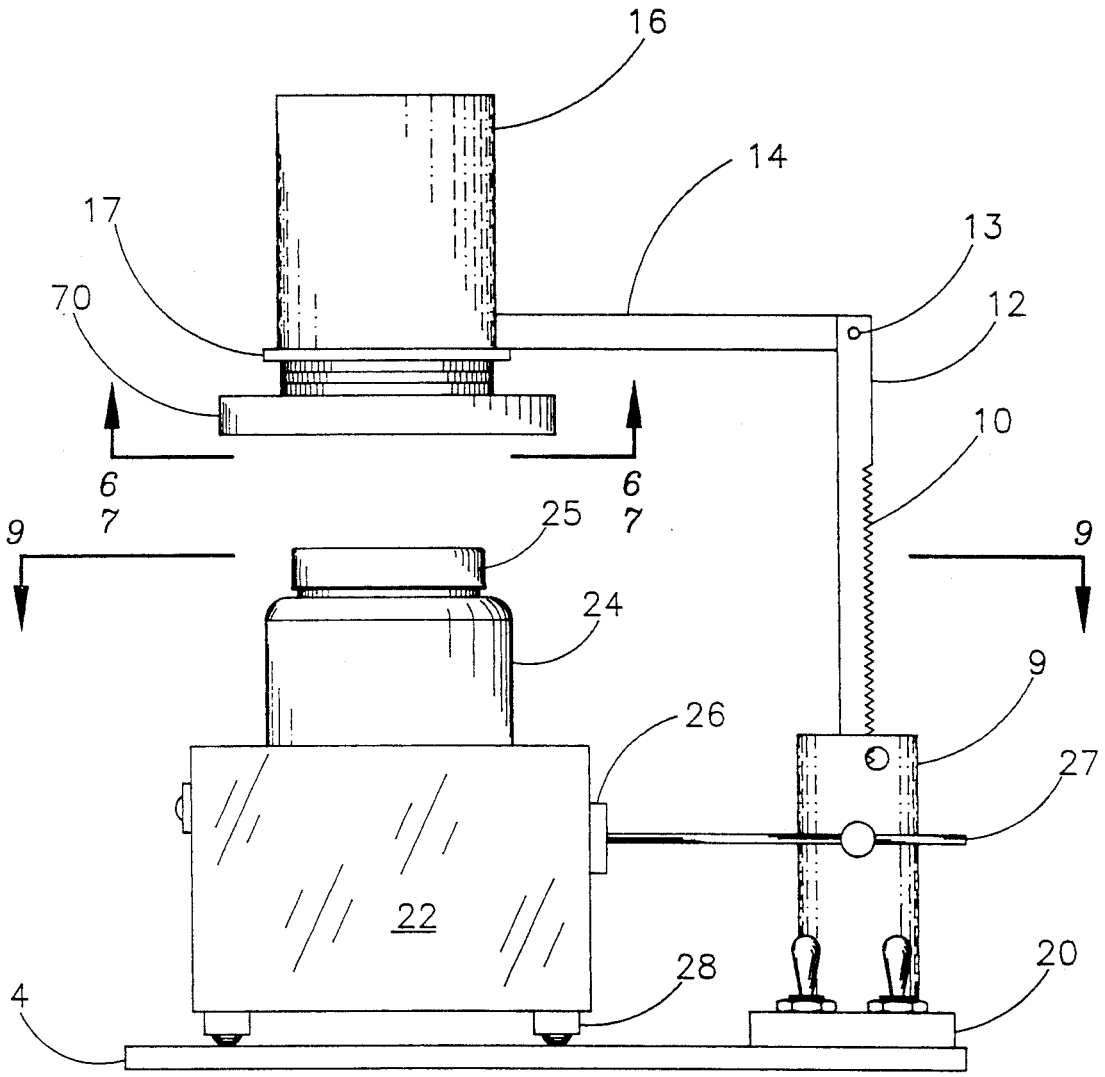
FIG. 3 is a side elevational view of the electrically operated self contained closure opener embodiment of the present invention with the opening mechanism shown in the retracted position.
Figure 4:
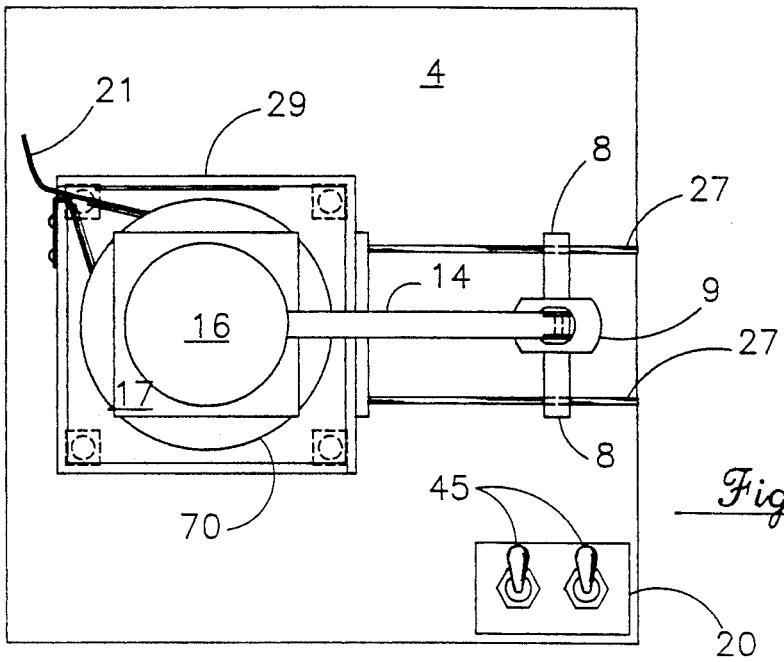
FIG. 4 is a plan view of the electrically operated self contained closure opener embodiment of the present invention.
Figure 5:
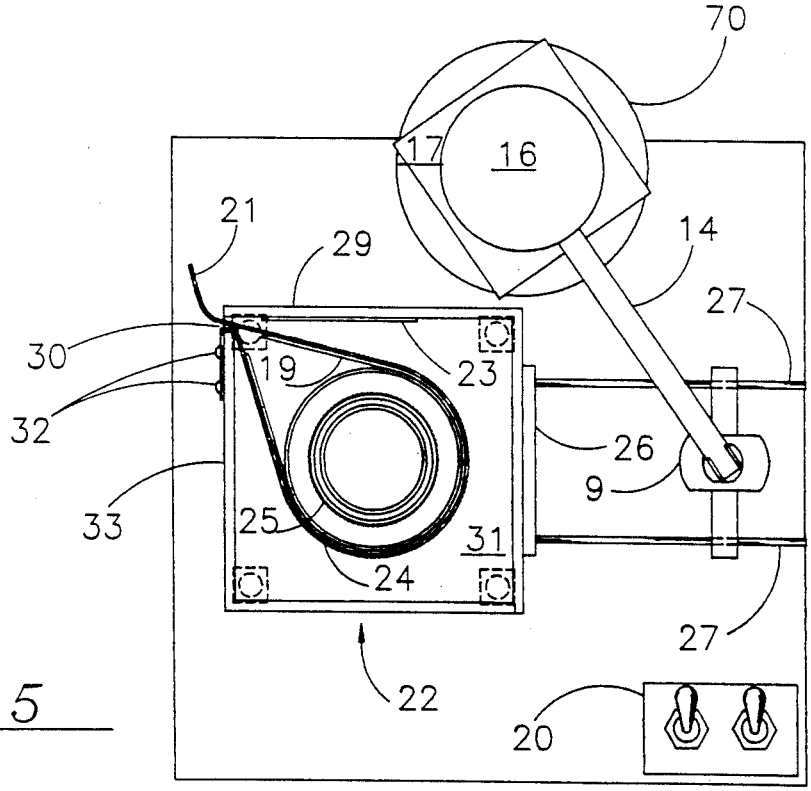
FIG. 5 is a plan view of the electrically operated self contained closure opener embodiment of the present invention shown with the drive head in the pivotal position.
Figure 6:
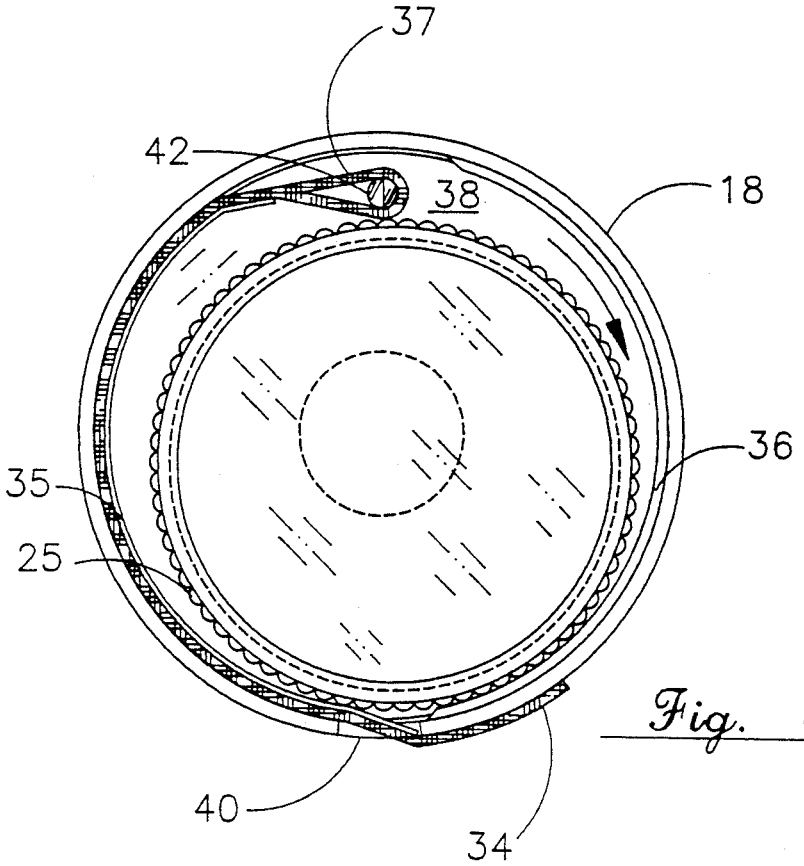
FIG. 6 is a bottom view as indicated in FIG. 3 of the drive head portion of the present invention shown with the friction strip of the full open position.

A bottom view of the torque head assembly 70, is shown in FIG. 6 with the self sizing strap loop 34, 35, shown in fully opened configuration.

Figure 7:
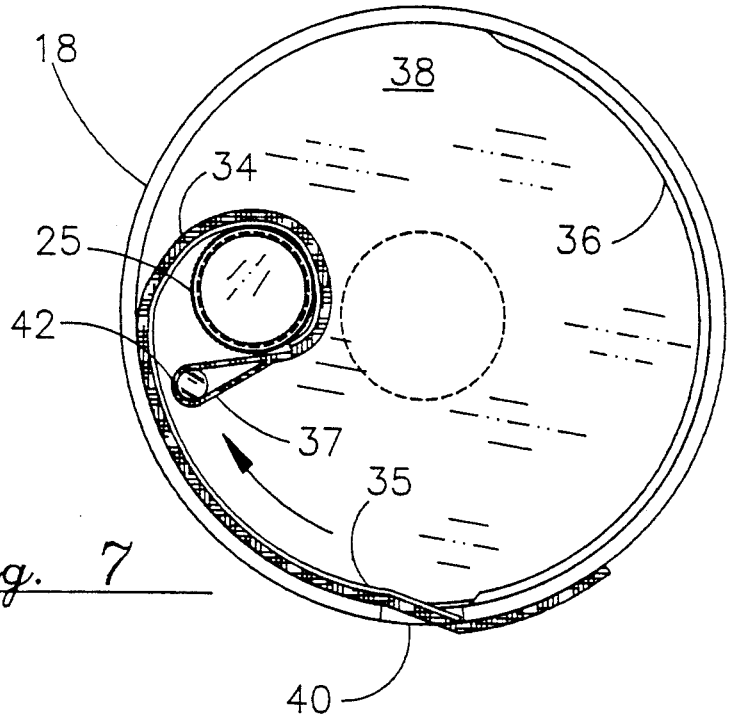
FIG. 7 is a bottom view as indicated in FIG. 3 of the drive head portion of the present invention shown with the friction strip in partially open position.

Whereas, in FIG. 7, the self sizing strap loop 34, 35, is shown in a tightening configuration. As the small disk 38 moves in its 360 degree rotation within the larger disk 18 causing the eccentric strap pin 42 to draw the strap 34, 35, into a decreasing spiraling loop. If the strap 34, 35, contacts a closure body, the strap 34, 35, continues to tighten until the closure and its container is forced against the friction strip 36 before it begins to rotate, and thereby locks the small disk 38 in frictional engagement with the larger disk 18. If no contact with a closure body is made the smaller disk 38 continues to rotate until the strap 34, 35, downsizes to infinity, where the strap loop 37 rotates about the eccentric strap pin 42 attached to the face of the small disk 38 and repeats the process.

Figure 8:
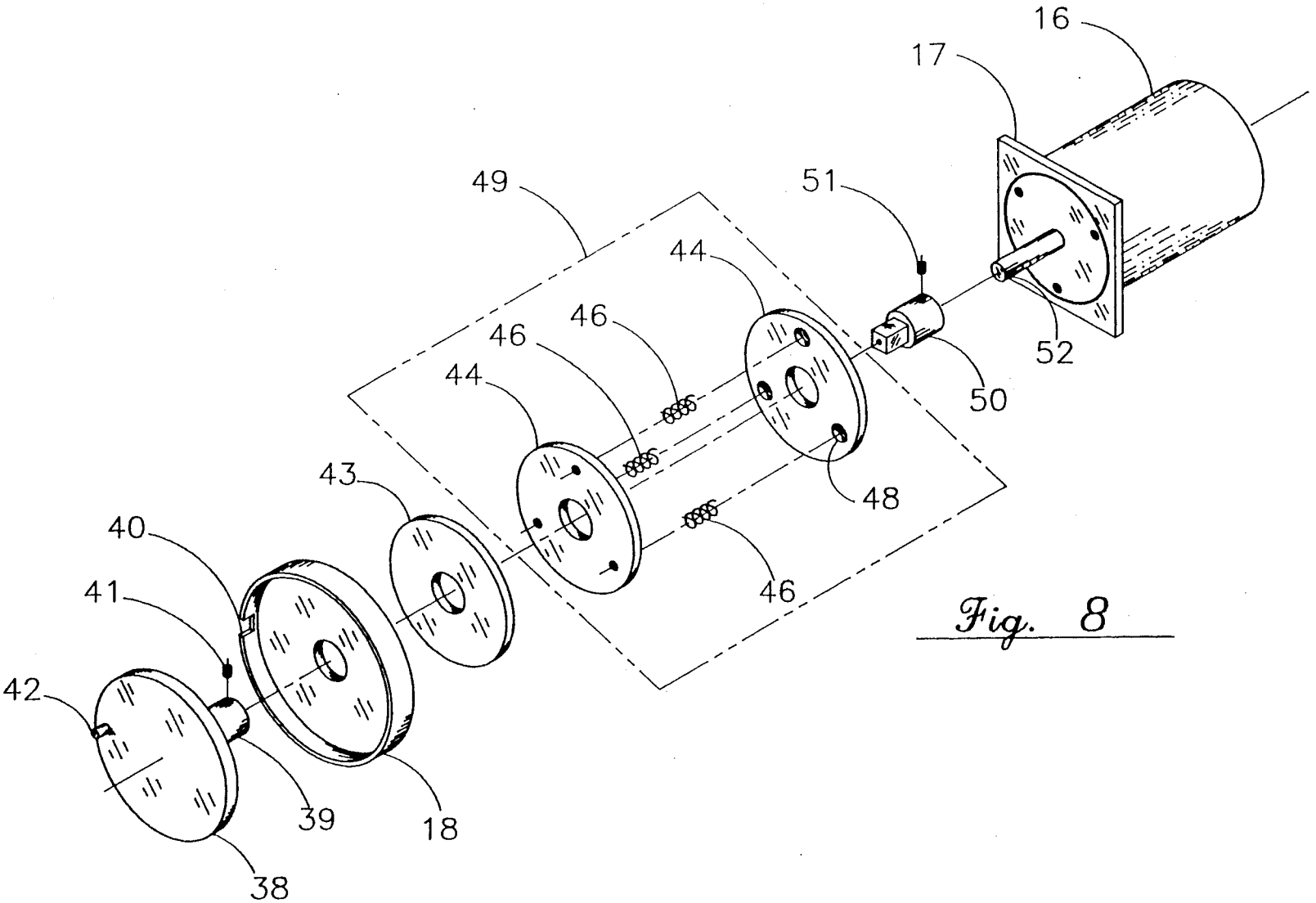
FIG. 8 is an exploded view of the drive head with electric motor adaptor and biased friction disk.

Looking now to FIG. 8 where an exploded view of the motor drive embodiment is shown. The torque head assembly 70, comprised of the two disk 38, 18 and whereas the smaller disk 38 shaft portion passes through the larger disk 18, and whereas the friction disk 71 is replaced by friction disk 43, and the shaft collar 73 is replaced by biasing assembly 49 comprising items 44 & 46, and wherein small disk shaft portion 39 is secured to the motor shaft adaptor 50 by a set screw means 41 and is in turn secured to the drive motor 16 shaft 52 by means of set screw 51. The biasing assembly 49 is comprised of two disk 44 held spaced apart by a plurality of springs 46 recessed 48 into the face of each disk. Biasing is accomplished by sandwiching the biasing assembly 49 between the faces of the motor flange 17 and larger disk 18. Biasing assembly 49 provides pressure to friction washer 43, allowing some slippage between the larger 18 and smaller disk 38. This slippage allows a container closure to be placed inside the friction strap 34, 35, whereby, engagement of strap 34 around the container closure is achieved by turning larger disk 18 by hand before the application of torque. However, allowing the smaller disk 38 to rotate under power will automatically size the strap loop 34, 35, around the container closure. When the friction strap 35 contacts a container's closure, the larger disk 18 is brought into locking engagement with smaller disk 38.

Figure 10:
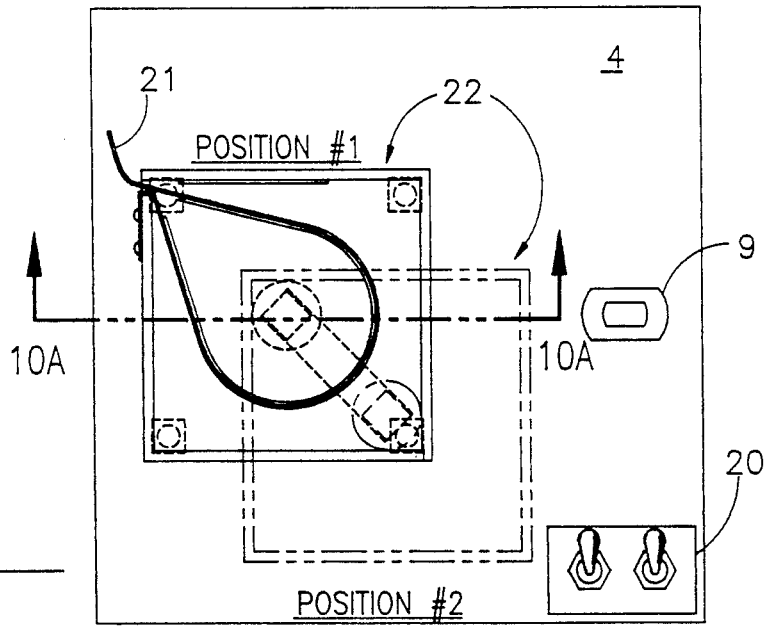
FIG. 10 is a plan view of the lower containment portion of the electrically operated self contained closure opener embodiment of the present invention showing maximum travel positioning with base guide slot option.
Figure 10A:
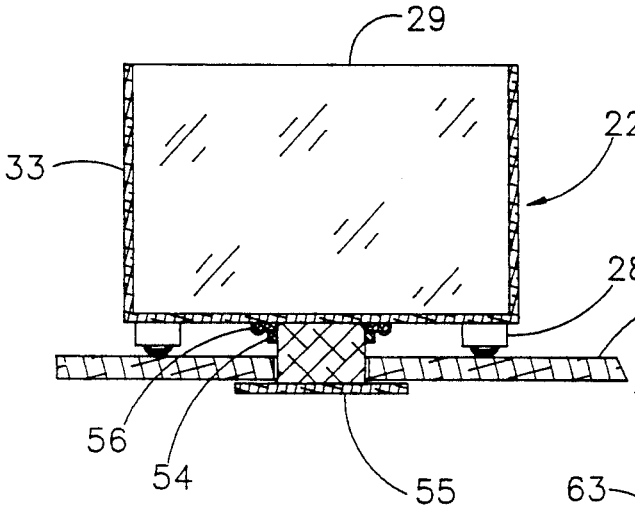
FIG. 10A is a cross section view of the base guide slot option for the lower containment portion of the electrically operated self contained closure opener embodiment of the present invention as viewed along the section line of FIG. 10.

Looking now at FIGS. 10 and 10A, a second embodiment is shown for controlling the movement of the containment portion 22 of the invention when secured to and in a working relation to the base plate 4. In this embodiment, a square rod 54 is secured to the base of the containment portion and is retained by a keeper 55 in a slot in the base plate 4 with freedom of travel limited to the diagonal path shown.

Figure 12:
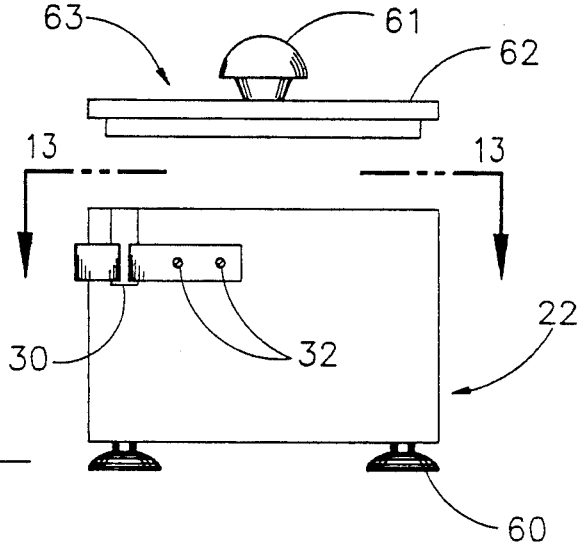
FIG. 12 is a side elevation view of the counter top embodiment of the containment portion of the present invention.
Figure 13:
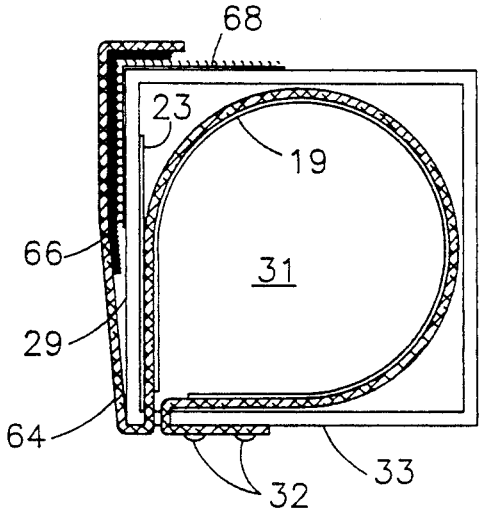
FIG. 13 is a plan view of the counter top embodiment of the containment portion of the present invention.
Figure 11:
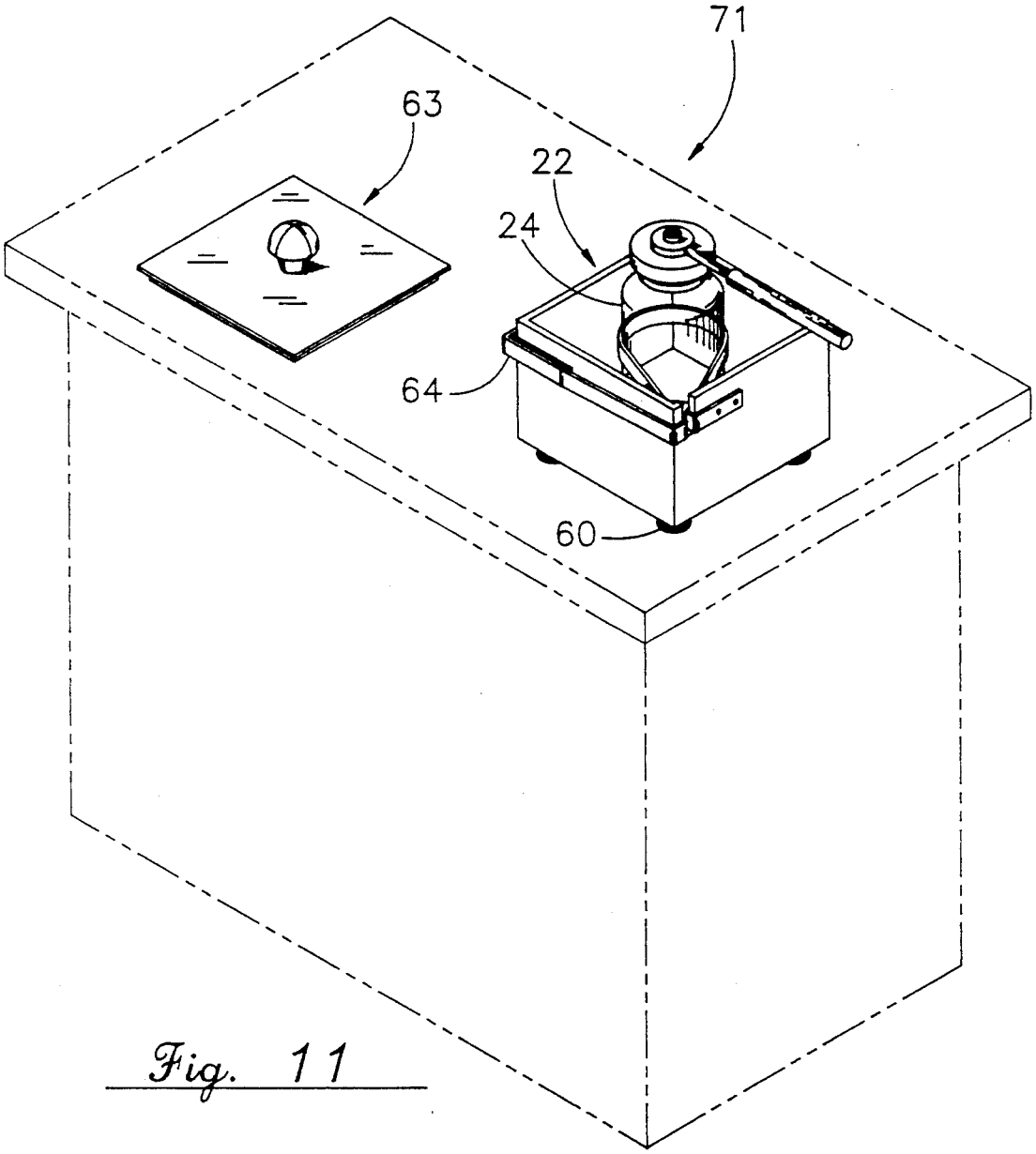
FIG. 11 is an isometric view of the counter top holding base embodiment in conjunction with the manual operated drive head embodiment.

A third embodiment of the containment portion of the invention as shown by FIGS. 12 and 13 wherein suction cups 60 are used to secure the containment to a counter top 71 or the like as shown in FIG. 11. A further refinement provides a lid 63 to be placed on the containment 22 when not in use. This embodiment may be used as a containment retainer portion when used with the manual handle 72 or torque wrench 74 operated torque head 70 shown in FIGS. 14 and 16. The strap loop 64 used in this embodiment is somewhat different in order to expedite the locking of a container without the self sizing actin of the containment loop. Therefore, a longer loop 64 having a friction strip 19 attached to one side of the hook portion and latch assembly on the outer is used so that the loop can be cinched manually and secured by means of a latch portion 68 of a hook an latch assembly attached to the exterior of the containment wall 29.

Figure 14:
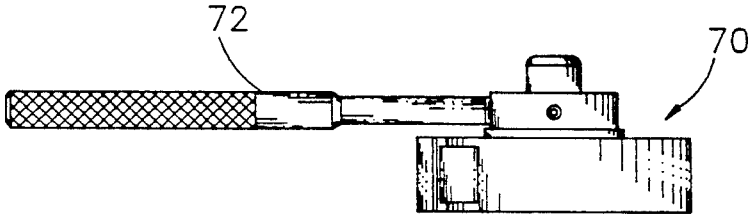
FIG. 14 is a side elevational view of the torque head assembly of the present invention shown with a manually operated handle.
Figure 15:
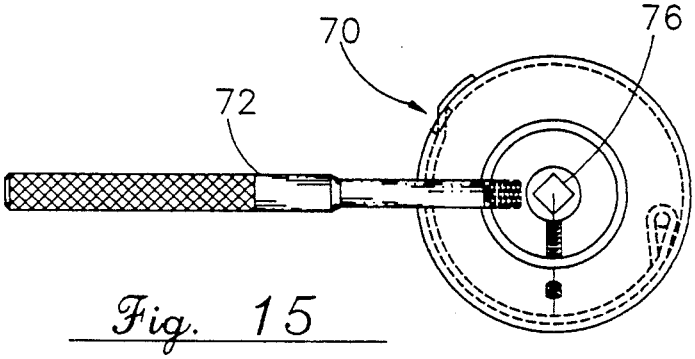
FIG. 15 is a plan view of the drive torque assembly of the present invention shown with a manually operated handle.
Figure 16:
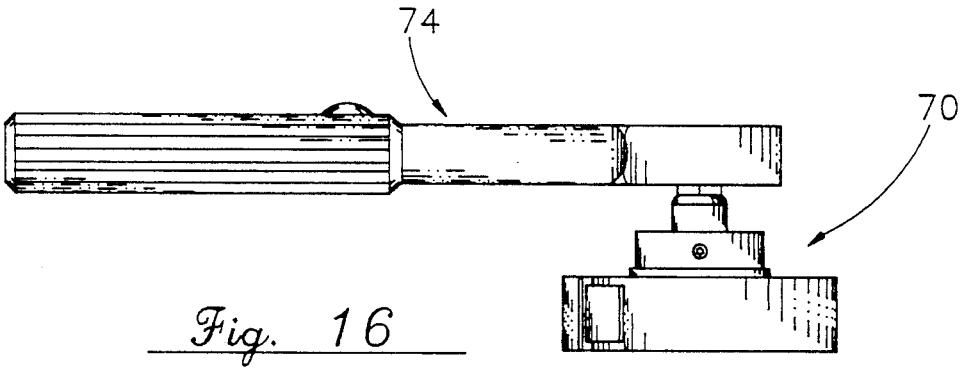
FIG. 16 is a side elevational view of the torque head assembly of the present invention shown with a battery powered drive ratchet handle attachment.
Figure 17:
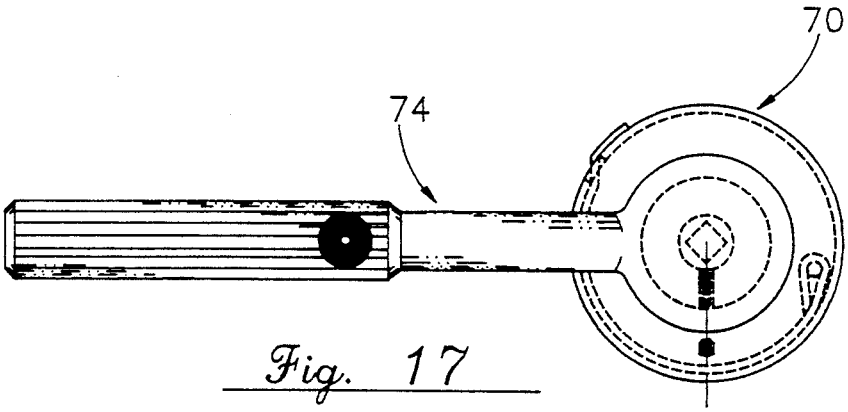
FIG. 17 is a plan view of the torque head assembly of the present invention shown with a battery powered drive ratchet handle attachment.
Figure 18:
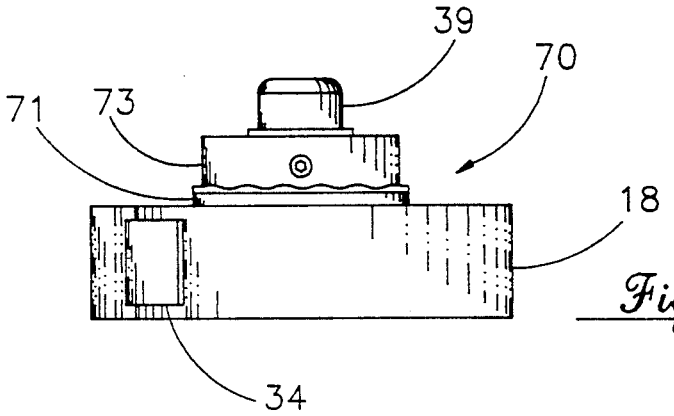
FIG. 18 is a side elevational view of the torque head assembly.
Figure 19:
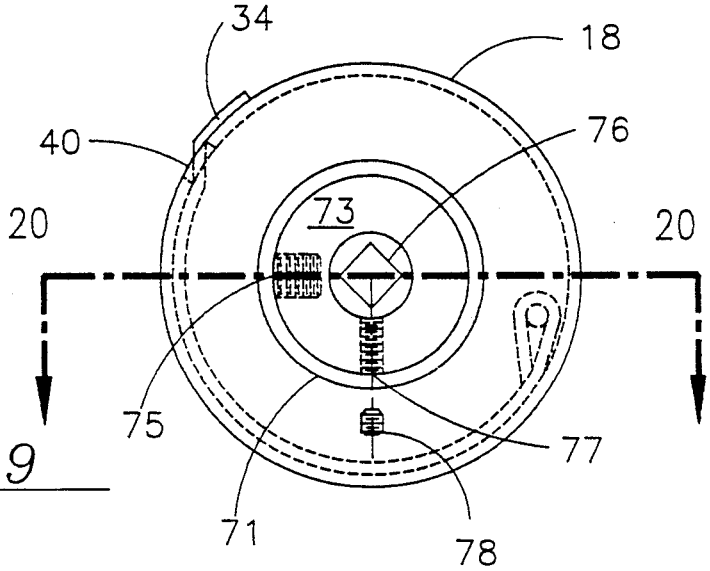
FIG. 19 is a plan view of the torque head assembly.
Figure 20:
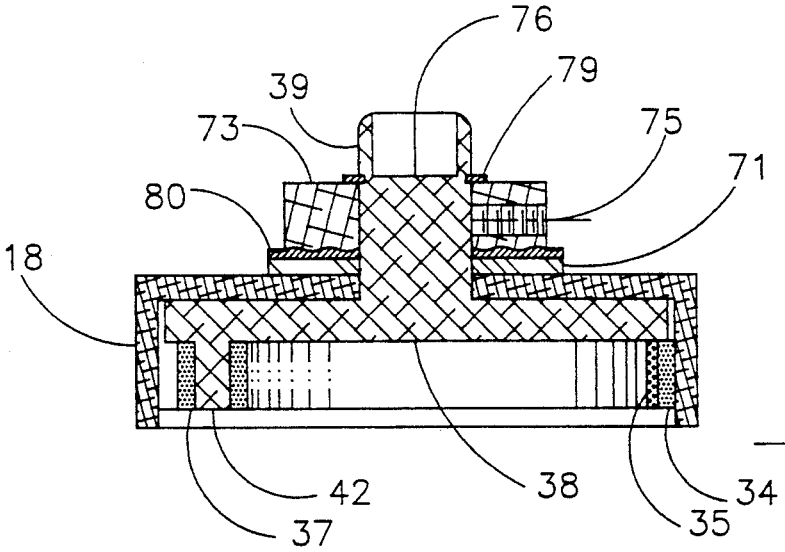
FIG. 20 is a cross sectional view taken along the section line shown in FIG. 19.

Looking now at FIG. 20, the make up of the torque head 70 is seen in cross section. A wave spring 80 is provided between the lock collar 73 and the friction washer 71 to allow friction drag between the larger disk 18 and the smaller disk 38. A retaining ring 79 is provided on the shaft portion 39 of the smaller disk 38 to retain the lock collar 73 in place, when a socket wrench is used to drive the torque head. In this configuration the lock collar's set screw 78 is released and thereby allows the lock collar to rotate freely about the shaft portion 39. This configuration eliminates the need to manually restrict rotation of the larger disk 18 in order to stimulate loop sizing. When a manual handle 72 as shown in FIGS. 14 and 15 is used to operate the torque head 70. The handle 72 is threadably attached to lock collar 73 by means of threaded hole 75. Lock collar 73 is secured to smaller disk shaft portion 39 by means of set screw 78. The lock collar 73 is held in a spaced apart relation with the larger disk by a friction disk 71 providing frictional drag between the large disk 18 and smaller disk 38. An optional torque head handle arrangement may be used as shown in FIGS. 16 and 17. Wherein a battery powered hand ratchet or socket wrench is employed to mate with the recessed square drive socket 76 located in the end of smaller disk shaft portion 39.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A torque head for installing or removing threaded lids from containers or jars comprising:

a) a small disk, having a shaft portion extending therefrom;

b) a pivot pin, extending from the face of said small disk;

c) a larger disk, rotatable concentrically about said small disk shaft portion, having a raised cylindrical wall, for housing said small disk;

d) a flexible strap, attached at one end to said larger disk and looped at its opposite end around said pivot pin;

e) a lock collar, for securing said larger disk on said small disk shaft portion;

f) a friction washer, between said larger disk and said collar, for maintaining drag between said smaller and larger disk; and g) a biasing means between said friction disk and said lock collar.

2. The apparatus of claim 1, wherein said shaft portion of said smaller disk further comprises; a square socket cavity located perpendicular to the end of said shaft portion, for inserting a square socket drive means and a retaining ring groove for retaining said lock collar.

3. The apparatus of claim 1, wherein said larger disk further comprises a slot in said raised cylindrical wall, for passing one end of said flexible strap.

4. The apparatus of claim 1, wherein said larger disk further comprises; a friction strip attached to a portion of the inside of said raised cylindrical wall.

5. The apparatus of claim 1, wherein said flexible strap further comprises; a loop formed at one end and a friction strip attached along one side.

6. The apparatus of claim 1, wherein said collar further comprises; a set screw for securing said collar to said small disk shaft portion.

7. The apparatus of claim 1, wherein said flexible strap attaches to said pivot pin by encircling said pivot pin allowing 360 degrees movement of said strap about said pivot pin.

8. The apparatus of claim 1, wherein said smaller disk rotates 360 degrees within said larger disk with said flexible strap attached.

9. The apparatus of claim 1, wherein said smaller disk is driven by a wrench means attached to said collar.

10. The apparatus of claim 1, wherein said small disk is driven by a handle means.

11. The apparatus of claim 1, wherein said small disk is driven by a powered motor.

12. The apparatus of claim 1, wherein said small disk is driven by an electric motor.

13. A torque head for installing or removing threaded lids from containers or jars comprising:

a) a small disk, having a shaft portion extending therefrom;

b) a pivot pin, extending from the face of said small disk;

c) a larger disk positioned about said small disk shaft portion, having a raised cylindrical wall, for housing said small disk;

d) a flexible strap, attached at one end to said larger disk and looped at its opposite end around said pivot pin;

e) a lock collar, for securing said larger disk on said small disk shaft portion;

f) a friction washer, between said larger disk and said collar, for maintaining drag between said smaller and larger disk;

g) a biasing means between said friction disk and said lock collar; and h) power means for rotating said smaller disk while said larger disk is maintained stationary so that the biasing means may engage the container lid to be loosened or tightened.

* * * * *